United States Patent [19]

Flavell

[11] 4,082,267

[45] Apr. 4, 1978

[54] BILATERAL ISOKINETIC EXERCISER

[76] Inventor: Evan R. Flavell, 841 Solano Ave. No. 5, Albany, Calif. 94706

[21] Appl. No.: 685,446

[22] Filed: May 12, 1976

[51] Int. Cl.[2] ..... A63B 21/00

[52] U.S. Cl. ..... 272/125; 272/129; 185/37; 74/141; 272/71

[58] Field of Search ..... 272/116, 117, 133, 132, 272/131, 71, 138, 140, 129, DIG. 5, DIG. 6, 125; 128/25 R; 254/145, 185 A, 185 R; 192/46; 185/37, 39; 188/71, 291; 74/136, 141; 73/379

[56] References Cited

U.S. PATENT DOCUMENTS

| | | | |
|---|---|---|---|
| 374,596 | 12/1887 | Gray et al. | 188/291 X |
| 1,279,633 | 9/1918 | Allen | 272/116 |
| 1,404,017 | 1/1922 | Etter | 74/137 |
| 3,465,592 | 9/1969 | Perrine | 272/125 X |
| 3,589,193 | 6/1971 | Thornton | 73/379 R |
| 3,765,245 | 10/1973 | Hampl | 73/379 |
| 3,784,194 | 1/1974 | Perrine | 272/125 |
| 3,848,467 | 11/1974 | Flavell | 272/116 |
| 3,896,672 | 7/1975 | Henson et al. | 272/DIG. 5 X |

FOREIGN PATENT DOCUMENTS

| | | | |
|---|---|---|---|
| 405,617 | 4/1967 | Australia | 272/130 |
| 475,603 | 7/1951 | United Kingdom | 272/129 |

*Primary Examiner*—William R. Browne

*Attorney, Agent, or Firm*—Owen, Wickersham & Erickson

[57] ABSTRACT

A proportioned resistance exercising apparatus capable of exercising two limbs synchronously or separately with a single resistance mechanism. Two limb-engageable drive input devices are connected through one-way clutches to a single rotary shaft, which is, in turn, drivingly connected to the proportioned isokinetic resistance-producing mechanism.

12 Claims, 2 Drawing Figures

BILATERAL ISOKINETIC EXERCISER

BACKGROUND OF THE INVENTION

The present invention relates generally to speed-regulated or isokinetic exercise apparatus, and more particularly to improvements in devices for simultaneously exercising two or more limbs.

Recent advancements in the design of exercise apparatus have emphasized the importance of simulating as closely as is practical the movements of the specific activity for which the training is performed. Often, however, it is found that in such activities as running, swimming, jumping, rowing, etc., the limbs of the body are naturally moved in a complexly coordinated fashion that is difficult to duplicate in a training device.

Exercise apparatus has previously been devised which attempts to simulate the natural movements of the body in athletic activities. However, those devices which most sucessfully approximate natural coordination often consist of separate exercisers for each limb. In other devices, more than one limb may be linked to a single exercise resistance mechanism, but movements are limited to simple, and unnatural, coordination relationships between the limbs.

In the specific case of isokinetic exercise apparatus, wherein the exercise resistance is provided by relatively sophisticated and expensive speed regulation mechanisms (see, for example, my U.S. Pat. No. 3,848,467), it is most impractical from an economic standpoint to utilize multiple exerciser mechanisms for a single apparatus. It is therefore a primary object of the present invention to improve upon prior devices in the provision of a bilateral isokinetic exerciser wherein multiple limbs of the body may be simultaneously and independently exercised against a resistance provided by a single speed regulation means.

SUMMARY OF THE INVENTION

In the present invention, a single isokinetic speed regulation mechanism provides exercise resistance to two or more limbs of the body in a bilateral fashion. Each limb is linked to the speed regulation mechanism through a separate one-way clutch such that it may be moved independently of the other limb or limbs. Any limb may be moved at the regulated speed or slower, and the several limbs may be exercised in a variety of coordination relationships with respect to each other, for example, synchronously or asynchronously, in unison or reciprocally, or any intermediate variation thereof.

Isokinetic exercise apparatus and methods which incorporate the structure and techniques described above and which are effective to function as described above constitute specific objects of this invention.

Other objects, advantages, and features of my invention will become apparent from the following detailed description of a preferred embodiment taken with the accompanying drawings.

DESCRIPTION OF A PREFERRED EMBODIMENT

Figure 1:
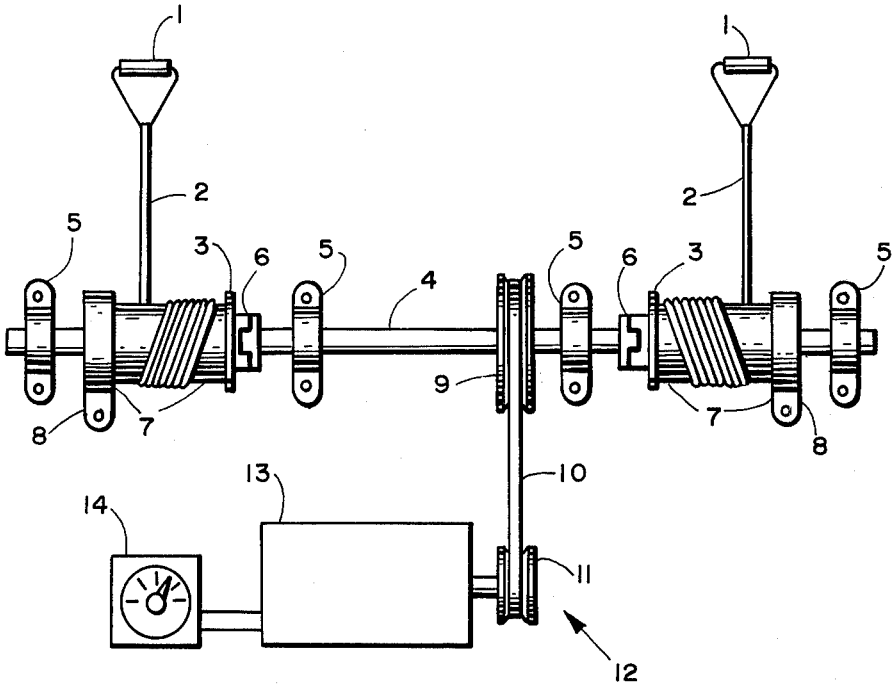
FIG. 1 is a view in elevation of a preferred embodiment of the invention.

A bilateral isokinetic exerciser constructed in accordance with one embodiment of the present invention is shown in FIG. 1. Here, a pair of stirrup handles 1 are provided for the exercising user to grip with his hands and which he pulls in any desired manner to obtain exercise from the device. The handles 1 are connected through separate cables 2 to a pair of rotatable spools 3 about which the cables are wound. Both spools 3 are mounted on a common drive shaft 4 supported by and free to rotate within bearings 5 which may be of the pillow block type. More than two handles, cables, and spools can be provided if it is desired to involve more than one pair of limbs in the exercise.

Each of the spools 3 is coupled to the drive shaft 4 via a separate one-way clutch 6 such that it is free to rotate on the drive shaft 4 in the recoil direction, but is directly coupled to, and transmits rotation to, the drive shaft 4 in the opposite, or power, direction. Any of a variety of mechanisms well known to those skilled in the art might serve as one-way clutches 6, such as roller clutches, wrap spring clutches, or dog-and-pawl devices (details not shown).

Each spool 3 is also connected to a power spring mechanism 7 which functions to constantly urge the spool in the recoil direction, thereby winding the cables 2 onto the spools 3 when the user permits recoil. The power springs 7, which are connected to and supported by mountings 8, may include spiral, helical or other well-known type torsion springs.

It may be seen that when the exercising user pulls on either or both of the handles 1, the cable 2 unwinds from the spool 3 causing it to rotate in the power direction, which rotation is transmitted through the clutch 6 to the drive shaft 4. When the user ceases to pull on either or both of the handles, the power spring mechanism 7 causes the respective spool 3 to rotate in the opposite direction, recoiling the cable 2 onto the spool. Rotation in the recoil direction, however, is not transmitted to the drive shaft 4 by the clutch 6, and the drive shaft 4 may continue to rotate in the power direction due to inertia, or it may be driven in the power direction by one spool while the other is recoiling. Thus, the user may pull the handles in any phase relationship with respect to each other, from synchronous to reciprocal.

Attached to the drive shaft 4 is a pulley 9 which, with a drive belt 10 and a second pulley 11, comprises a power transmission linkage to a speed regulation mechanism indicated generally by the reference numeral 12. The speed regulation mechanism 12 provides the exercise resistance of the apparatus by opposing any force applied by the exercising user which would cause it to exceed the regulation speed.

To those skilled in the art many mechanisms are known which might be used to generate this "isokinetic" exercise resistance, such as the mechanical and hydraulic devices described in U.S. Pat. Nos. 3,465,592 and 3,784,194 to J. J. Perrine, the centrifugal governor devices of U.S. Pat. Nos. 3,640,530 and 3,896,672 to Henson et al., or the electronic and electromechanical servo systems shown in Wilson U.S. Pat. No. 3,902,480 and Flavell U.S. Pat. Nos. 3,848,467 and 3,869,121.

In this embodiment of the present invention, the isokinetic speed regulation system 12 consists of a direct current generator 13 operated as a dynamic brake by electronic control circuitry 14. Details of the construction of the speed regulation mechanism 12 are shown in the schematic diagram of FIG. 2. Here, the direct current generator 13, driven by the drive shaft 4 of FIG. 1 via the power transmission belt 10 and the pulleys 9 and 11 of FIG. 1, generates a voltage output proportional to its speed of rotation. As its speed of rotation and consequent output voltage approach a value established in one of several voltage reference elements 15 selected by a manually operated selector switch 16, current begins to flow through a series resistance 17 and a variable shunt element 18, which may comprise Darlington-connected power transistors.

It may be seen that any increase in speed of rotation of the generator 13 above that corresponding to a voltage output equivalent to that of the selected voltage reference 15 can only occur via overcoming a proportional increase in the dynamic braking forces of the generator 13. These dynamic braking forces result from the consequential increase in current flow in the armature of the generator, since the variable shunt element 18 maintains a generator output voltage substantially in accordance with the selected voltage reference 15. Depending on the position of the switch 16, one of the three reference elements 15 is in the circuit. These elements $VR_1$, $VR_2$, and $VR_3$ each set a different speed.

Figure 2:
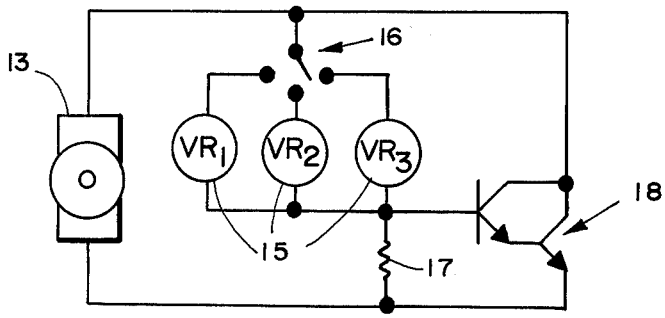
FIG. 2 is a simplified schematic diagram of the speed regulation system of the apparatus shown in FIG. 1.

Thus, the components indicated in FIG. 2 regulate the speed of the exercise apparatus by increasing and decreasing dynamic braking forces in opposition to and in proportion to user-induced speed increases and decreases above the chosen regulation speed.

If desired, the exercising system can include a performance display readout as disclosed in my U.S. Pat. No. 3,848,467.

Many and varied applications of this bilateral isokinetic exerciser will be apparent to those skilled in the art. For example, it might be easily adapted to simulate swimming stroke movements with the user lying face down on a narrow exercise bench and the apparatus mounted at a suitable height and distance in front of him. Having preselected the desired speed of exercise with the speed selector switch 16, he would grip the handles 1 and pull on the cables 2, moving the arms in a manner similar to that used in a specific swimming stroke. It may be seen that the apparatus is well suited for performance of all types of swimming strokes in obtaining exercise, including freestyle, backstroke, butterfly, and breaststroke, in spite of the fact that in some strokes the arms must move in unison, while in others, they must move in a semi-reciprocal fashion. The position of the apparatus with respect to the user may be varied to suit the particular type of stroke.

As the exercising user performs the desired swimming stroke, it may be seen that as long as he moves his arms at less than the selected speed, his efforts are opposed only by the inherent friction and inertia of the apparatus. In most cases, it is desirable to minimize the resistance offered by these forces, such that the user may easily accelerate the device to, and sustain its movement at, the regulation speed. Once the user has accelerated the apparatus to the regulation speed, the speed regulation mechanism 12 opposes further acceleration of the device with a variable resistance and thereby affords resistance to the efforts of the user in proportion to those efforts. That is, above the preselected regulation speed, the harder the exercising user pulls on the device, the harder its speed regulation mechanism resists the pull. Each incremental increase in input force is resisted by an increased opposing force, so that higher speeds become increasingly more difficult to attain. Available isokinetic devices can greatly vary the factor of proportionality; thus a small increase in speed can be made to produce a large increase in resistance, or a large increase in speed can be made to produce only a relatively small increase in resistance. The proportionality may thus be adjusted as desired, for the rotational speed regulating means 12 may include well-known means for adjusting the resistance provided for a given rotational speed. One way of doing this is to provide a series of generators 13 with different regulation constants as a result of how they are wound and the flux of their magnet. Other ways are shown in my U.S. Pat. No. 3,848,467. In performing the swimming strokes, then, the user may obtain exercise from the device by exerting whatever effort he desires or is capable of exerting in the power portion of each stroke. The apparatus will provide the user with a resistance proportioned to his effort by regulating the speed of his movement.

At the end of each stroke, the user ceases to pull on the handle 1 and cable 2 and returns his arms to the starting position. During this recovery portion of each stroke, it may be seen that the clutch 6 disengages from the drive shaft 4 and the cable 2 is recoiled by the power spring 7. The dual clutches 6 permit one arm to be recovering while the other is stroking, or both arms to recover and stroke simultaneously, or the two arms to move in any desired relationship with respect to each other between these two extremes. It is this feature specifically which affords the apparatus sufficient versatility in bilateral coordination to permit close simulation of natural body movements in exercise.

In the present embodiment of the invention, handles 1, cables 2, and spools 3 are employed to transmit the forces exerted by the user through the clutches 6 to the drive shaft 4. It will be apparent to those skilled in the art that alternative interfacing means of force transmission such as levers, etc., are equally suited to the purpose of translating exercise movements into system drive shaft rotation.

The following advantages are among those obtained by the invention:

(1) Complexly coordinated natural body movements may be easily simulated in exercise, giving maximum transfer of training effectiveness to athletic activities.

(2) A wide variety of bilateral exercise movements may be performed with a single exercise resistance mechanism. Previously this level of versatility would require multiple exercisers.

(3) Through the use of a single speed regulation mechanism, both limbs are exercised at the same speed. On prior devices, synchronization of multiple exercisers was impractical.

To those skilled in the art to which this invention relates, these and many other such changes in construction and widely differing embodiments and applications of the invention will suggest themselves without departing from the spirit and scope of the invention. The disclosures and the description herein are purely illustrative and are not intended to be in any sense limiting.

I claim:

1. Bilateral isokinetic exercising apparatus, comprising:

a plurality of limb-engageable input means for responding to a power stroke in a power direction of reciprocating movement, so that a person exercising can move each input means with one limb in the power direction, a plurality of converting means each connected to one only of said input means for converting the reciprocating movement of each said input means into a separate rotational motion, each said converting means including its own rotatable member that is acted on by that rotational motion, a single speed regulating means for opposing rotational movement of any and all said rotatable members with proportioned isokinetic resistance, driving connection means for connecting all said rotatable members to said speed regulating means and including separate one-way clutch means for connecting each said rotatable member to said speed regulating means and transmitting connection means for each said clutch for providing that movement of each input means in a first power direction drives said speed regulating means, and for providing that movement of each said input means in the opposite direction is disengaged from said speed-regulating means, whereby motion of each input means in the power direction by the person exercising is opposed by said speed-regulating means with a resistance force proportional to the force applied by the person exercising, whereas movement of each said input means in the opposite direction is unopposed by said speed-regulating means.

2. The apparatus of claim 1 wherein the converting means includes a flexible tension line connected to each input means, said rotatable member comprising a winding spool connected to and receiving windings of the tension line, each one-way clutch means being so positioned to be engaged with the speed regulating means when the associated tension line is unwinding, and disengaged when the tension line is winding onto the spool.

3. The apparatus of claim 2 wherein the driving connection means includes a rotatable shaft drivingly connected to the speed regulating means and to all of the one-way clutches.

4. The apparatus of claim 1 wherein the driving connection means includes a rotatable shaft drivingly connected to the speed regulating means and to all of the one-way clutches.

5. The apparatus of claim 1 wherein the speed regulating means includes means for adjusting the resistance provided for a given rotational speed.

6. The apparatus of claim 1 having means for adjusting the regulating speed of said speed regulating means.

7. The apparatus of claim 1, further including a plurality of recoil means each connected to one said rotatable member for urging said rotatable member and said input means in a direction opposite to said power direction, so that relaxation by the person exercising transmitted to any said input means enables said recoil means to restore that said input means to a starting position.

8. The apparatus of claim 1 wherein said speed regulating means includes:

variable resistance means for opposing user input forces, and means responsive to the speed of said variable resistance means for controlling the variable resistance means according to the speed of user input movement.

9. The device of claim 8 wherein:

said variable resistance means comprises an electrical generator and means for loading the electrical output of said generator, and said control means includes means for varying said electrical load.

10. The device of claim 9 wherein:

said electrical loading means comprises power semiconductor means connected to the output of said electrical generator, and said control means further includes driving circuit means connected to said power semiconductor means and responsive to the difference between the generator output voltage and a selected voltage reference.

11. The device of claim 1 wherein the speed regulating means includes means for adjusting the resistance provided for a given difference between the actual rotational speed and a preset regulation speed.

12. Bilateral isokinetic exercising apparatus, comprising:

a plurality of rotatable drums, a corresponding plurality of limb-engageable input means for responding to back-and-forth movement of a limb, said movement including a power direction and a relaxation direction, each said input means including a cable partly wound around one said drum for converting the back-and-forth movement of each said input means into rotational motion of said drum, with a power direction of rotation and a relaxation direction of rotation, a corresponding plurality of recoil spring means, each connected to one said drum for urging said drum and said input means in the relaxation direction, so that relaxation by the person exercising transmitted to any said input means enables said recoil means to restore that said input means to a starting position, a common rotatable shaft, separate one-way clutch means for connecting each said drum to said common shaft during rotation thereof in the power direction and for disengagement therefrom for rotation in the relaxation direction, and dynamic brake means operatively connected to said common rotatable shaft and thereby to each said one-way clutch means and therethrough to each said drum when its said one-way clutch means is engaged, for opposing rotational movement of any and all said drums with proportioned isokinetic resistance when their respective one-way clutches are engaged.

* * * * *

UNITED STATES PATENT AND TRADEMARK OFFICE

CERTIFICATE OF CORRECTION

PATENT NO. : 4,082,267

DATED : April 4, 1978

INVENTOR(S) : Evan R. Flavell

It is certified that error appears in the above-identified patent and that said Letters Patent are hereby corrected as shown below:

Item [56] References Cited, under FOREIGN PATENT DOCUMENTS, in the right hand column of the cover page, "United Kingdom" should read --Canada--.

Column 5, line 18, as counted from top of column, "each input means" should read --each said input means--.

Signed and Sealed this

*Twenty-eighth* Day of *November 1978*

[SEAL]

*Attest:*

RUTH C. MASON
*Attesting Officer*

DONALD W. BANNER
*Commissioner of Patents and Trademarks*

US004082267B1

REEXAMINATION CERTIFICATE (1986th)

United States Patent [19]

Flavell

[11] B1 4,082,267

[45] Certificate Issued Apr. 27, 1993

[54] BILATERAL ISOKINETIC EXERCISER

[76] Inventor: Evan R. Flavell, 841 Solano Ave. No. 5, Albany, Calif. 94706

Reexamination Request:
No. 90/002,637, Feb. 7, 1992

Reexamination Certificate for:

| | |
|---|---|
| Patent No.: | **4,082,267** |
| Issued: | **Apr. 4, 1978** |
| Appl. No.: | **685,446** |
| Filed: | **May 12, 1976** |

Certificate of Correction issued Nov. 28, 1978.

[51] Int. Cl.[5] ..... A63B 21/00

[52] U.S. Cl. ..... 482/6; 74/141; 185/37; 482/92

[58] Field of Search ..... 482/1-9, 482/55, 56, 92, 93, 114-130, 900, 903; 120/25 R; 254/145, 185 A, 185 R; 192/46; 185/37, 39; 188/71, 291; 74/136, 141; 73/379

[56] References Cited

U.S. PATENT DOCUMENTS

| | | | |
|---|---|---|---|
| 444,881 | 1/1891 | Gardiner . | |
| 670,006 | 3/1901 | Raymond . | |
| 3,584,871 | 6/1971 | Kelmon | 482/123 |
| 3,640,530 | 2/1972 | Henson et al. . | |
| 3,874,659 | 1/1975 | Aharoni . | |
| 3,929,331 | 12/1975 | Beeding . | |
| 4,063,726 | 12/1977 | Wilson . | |
| 4,148,479 | 4/1979 | Spector | 482/112 |
| 4,385,760 | 5/1983 | Mattox et al. | 482/91 X |
| 4,452,447 | 6/1984 | Lepley et al. | 482/113 X |
| 4,466,610 | 8/1984 | Isreal | 482/91 |

OTHER PUBLICATIONS

Counsilman, J., "Isokinetic Exercise: A New Concept in Strength Building, " *Swimming World,* vol. 10, No. 11, 1969.

Katch, F., "Measuring Leg Force-Output Capacity with an Isokinetic Dynamometer-Bicycle Ergometer", *The Research Quarterly,* vol. 45, No. 1, Mar. 1974, pp. 86-91.

*Primary Examiner*—R. D. Bahr

[57] ABSTRACT

A proportioned resistance exercising apparatus capable of exercising two limbs synchronously or separately with a single resistance mechanism. Two limb-engageable drive input devices are connected through one-way clutches to a single rotary shaft, which is, in turn, drivingly connected to the proportioned isokinetic resistance-producing mechanism.

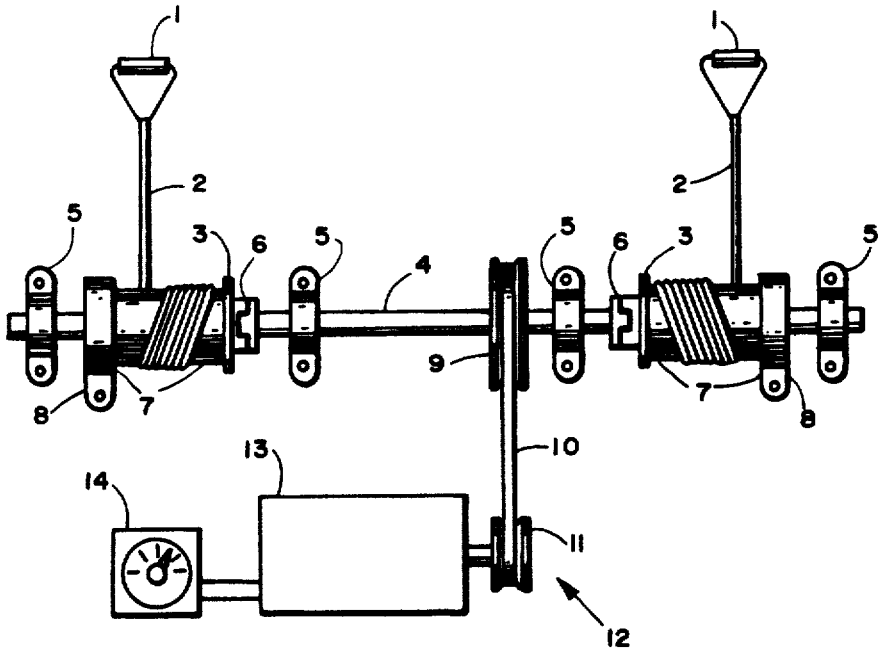

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 12 are determined to be patentable as amended.

Claims 2-11, dependent on an amended claim are determined to be patentable.

1. Bilateral isokinetic exercising apparatus, comprising:

a plurality of limb-engagable input means for responding to a power stroke in a power direction of reciprocating movement, so that a person exercising can move each input means with one limb in the power direction, a plurality of converting means each connected to one only of said input means for converting the reciprocating movement of each said input means into a separate rotational motion, each said converting means including its own rotatable member that is acted on by that rotational motion, a single speed regulating means for opposing rotational movement of any and all said rotatable members with proportioned isokinetic resistance, *such that below a selected speed the user encounters minimal resistance and at or above the selected speed the user encounters a resistance proportioned to the force applied by the person exercising,* driving connection means for connecting all said rotatable members to said speed regulating means and including separate one-way clutch means for connecting each rotatable member to said speed regulating means and transmitting connection means for each said clutch for providing that movement of each said input means in a first power direction drives said speed regulating means, and for providing that movement of each said input means in the opposite direction is disengaged from said speed-regulating means, whereby motion of each input means in the power direction by the person exercising is opposed by said speed-regulating means with a resistance force proportional to the force applied by the person exercising, whereas movement of each said input means in the opposite direction is unopposed by said speed-regulating means.

12. Bilateral isokinetic exercising apparatus, comprising:

a plurality of rotatable drums, a corresponding plurality of limb-engagable input means for responding to back-and-forth movement of a limb, said movement including a power direction and a relaxation direction, each said input means including a cable partly wound around one said drum for converting the back-and-forth movement of each said input means into rotational motion of said drum, with a power direction of rotation and a relaxation direction of rotation, a corresponding plurality of recoil spring means, each connected to one said drum for urging said drum and said input means in the relaxation direction, so that relaxation by the person exercising transmitted to any said input means enables said recoil means to restore that said input means to a starting position, a common rotatable shaft a separate one-way clutch means for connecting each said drum to said common shaft during rotation thereof in the power direction and for disengagement therefrom for rotation in the relaxation direction, and dynamic brake means operatively connected to said common rotatable shaft and thereby to each said one-way clutch means and therethrough to each said drum when its said one-way clutch means is engaged for opposing rotational movement of any and all said drums with proportional isokinetic resistance when their respective one-way clutches are engaged, *such that below a selected speed the user encounters minimal resistance and at or above the selected speed the user encounters a resistance proportioned to the force applied by the person exercising.*

* * * * *